US005681040A

United States Patent [19]

Peterson

[11] Patent Number: 5,681,040

[45] Date of Patent: Oct. 28, 1997

[54] GAME TIMER

[76] Inventor: Mark S. Peterson, 1700 N. Tully Rd. #A-116, Turlock, Calif. 95380

[21] Appl. No.: 717,819

[22] Filed: Sep. 24, 1996

[51] Int. Cl.[6] ..... A63F 9/00

[52] U.S. Cl. ..... 273/148 R; 273/445; 368/3; 446/389

[58] Field of Search ..... 273/148 R, 445, 273/446, 447; 368/3, 90, 101, 327; 446/342, 389

[56] References Cited

U.S. PATENT DOCUMENTS

| | | | |
|---|---|---|---|
| 3,081,997 | 3/1963 | Glass et al. | 446/342 X |
| 4,021,046 | 5/1977 | Barlow | 273/148 R |
| 4,339,798 | 7/1982 | Hedges et al. | 364/412 |
| 4,363,489 | 12/1982 | Chodak et al. | 273/237 |
| 4,385,762 | 5/1983 | Schwartz | 273/16 C |
| 4,828,531 | 5/1989 | Kuhn | 446/389 X |
| 4,875,164 | 10/1989 | Monfort | 364/412 |
| 5,050,887 | 9/1991 | Kemp | 273/237 |
| 5,310,190 | 5/1994 | Morris | 273/243 |
| 5,439,228 | 8/1995 | Pedersen | 273/236 |
| 5,458,342 | 10/1995 | Hernandez | 273/447 |

*Primary Examiner*—William H. Grieb

*Attorney, Agent, or Firm*—Gene Scott - Patent Law & Venture Group

[57] ABSTRACT

A game timer is constructed in a form resembling an eye with a movable eye lid. The lid is positionable to cover the eye and to uncover the eye in accordance with an objective of the game in the timing of events in the game. Because the eye is an icon of knowledge and power, the psychological connection of such an icon with a game of information, the answering of questions and the evaluation of intellect, composure and other competitive aspects of human nature is important to the success of the game. A numerical processor and associated elements of the device provide programmability for controlling various aspects of the game and for keeping score.

7 Claims, 2 Drawing Sheets

GAME TIMER

BACKGROUND OF THE INVENTION

1. Field of the Invention

This invention relates generally to a game timer, and more particularly to numerical processor based timer for controlling a moving element for generating suspense in the game.

2. Description of Related Art

The following art defines the present state of this field:

Monfort, U.S. Pat. No. 4,875,164 describes a processing system for a gambling game including a first, self-contained and portable device enabling the reading, erasing and inscription on a data medium as well as the verification of the result of a drawing; a second fixed device associated with a computer of a betting management center enabling the reading of data written on the data medium by the first device, transmission to the management center for recording the read data of the bets, indication and optionally collection of sums of money to be collected as a stake and the inscription on the data medium in an area to which the first device has no access of indications relative to bet data. A drawing is defined to be the contents of future event, the forecasting of which by a gambler allows him to win at least part of a stake.

Kemp, U.S. Pat. No. 5,050,887 describes an apparatus including a game board with a lattice-work of intersecting highway paths, with the highway paths including intersecting portions defined by an intersection of each of the paths, wherein the intersection portions include off and on ramps, where each of the highway paths include a spaced plurality of apertured pathways to receive dowels from associated player tokens. The tokens are directed to proceed along the apertured pathways by a directional controlling unit. The directional controlling unit includes sequentially and randomly illuminated light members to indicate whether a player token is to proceed. Each player must culminate movement within a time frame by an associated time clock, with game cards and dice utilized to create obstacles and assess penalties and damages and the like upon players who create accidents or other mistakes of judgment resulting in a lack of progress during a predetermined time internal.

Morris, U.S. Pat. No. 5,310,190 describes a board game that has a board defining a plurality of pockets symmetrically situated around a periphery of the board and a plurality of depressions for accepting movable game pieces. A rotating shaft of an electric motor is positioned in the center of the board, the electric motor being powered by a battery and controlled by a switch. An outwardly extending arm is attached to rotate with the shaft. A horse figure is permanently attached to the rotating arm, the horse figure being configured to pass over the plurality of pockets. Atop the horse figure is positioned a cowboy figure separate from and removably connected to the horse figure. A plurality of bumps and ridges are positioned between the plurality of pockets and a center of the board for jostling contact with the arm and the connected horse figure and cowboy figure, causing random or semi-random detachment of the cowboy figure falling into one of the plurality of pockets to determine movement of game pieces.

Pedersen, U.S. Pat. No. 5,439,228 describes a game playing apparatus for use with a signaling device includes sheet material defining a confined playing area and an array of locations delineated on the playing area. The playing area is sized to permit the players to move around the playing area when a signal to start movement is given by the signaling device, and the array of locations is sized and spaced to permit a player to occupy each location of the array of locations when a signal to stop movement is given by the signaling device. The game is played like the well-known game of musical chairs, with the locations serving as the "chairs". Discs are provided to cover locations after successive rounds so that the number of available locations is less than the number of players competing in each round.

Hedges et at., U.S. Pat. No. 4,339,798 describes a remote gaming system for use with a wagering or gambling establishment such as a casino to enable a player's participation's in a selected one of a plurality of wagering games from a remote location. The system includes a croupier station, a credit station and a player station remotely located from the croupier station and the credit station. The player station includes a live game display for displaying a selected one of a plurality of games being played at the croupier station, such as craps, roulette or keno. The player station includes a changeable playboard for displaying a selected one of a plurality of wagering possibilities corresponding to a selected one of the plurality of games being played at the croupier station. The player station also includes a microprocessor for controlling the operation of the live game display and the changeable playboard.

Chodak et at., U.S. Pat. No. 4,363,489 describes an electronic stock market game having a plurality of display and input positions at which players may trade in stock listed by the game. Each display shows a player, the price at which a stock is selling and gives general and specific information affecting the price of the stocks. A player selects a stock to trade in and keys in his order. A microprocessor executes the order, if possible, and controls the display to indicate the status of all stocks and the players account. The object of the game is to accumulate assets having over a predetermined value.

Schwartz, U.S. Pat. No. 4,385,762 describes a game including a set of pieces having different outlines or otherwise differently configured whereby each is engageable into an individual location on a playing surface e.g. by insertion therein. A set of display elements each associated with one of the locations may be activated to indicated visibly when a piece is to be engaged with its associated location. A switch associated with each location is so arranged as to be operable when, and only when, the piece of the correct configuration is engaged in the location. An electrical operating circuit activated the display elements successively in an initial period and then activated only one display element. When the correct piece is engaged with the location corresponding to the activated display elements the control circuit responds by deactivating the display element or by adjusting the sound from a sound source.

The prior art teaches various games of chance and skill. However, the prior art does not teach that a game icon may be used for the building of suspense in a game through the use of a movable shutter and does not teach a manner of fulfillment. The present invention fulfills these needs and provides further related advantages as described in the following summary.

SUMMARY OF THE INVENTION

The present invention teaches certain benefits in construction and use which give rise to the objectives described below.

The present invention provides a game timer constructed in the form of an eye with a movable eye lid. The lid is positionable to cover or uncover the eye in accordance with an objective of the game in the timing of game events. Because the eye is an icon of knowledge and power, the psychological connection of such an icon with a game of information, the answering of questions and the evaluation of intellect, composure and other competitive aspects of human character is important to the operation of the game. A numerical processor and associated circuit elements of the device, including input and display elements, provide programmability for controlling various aspects of the game and for keeping score.

A primary objective of the present invention is to provide a game timer having a controllable time duration. Another objective is to provide a shuttered game icon generating a visual image of power and knowledge. A further objective is to provide a means for moving the shutter in conjunction with a method of play in the game, the closing of the shutter and possibly the speed of closing being important elements in the building of suspense in the game and providing a basis for the evaluation of player composure and knowledge.

The inventive shell construction, the movable shutter as an operant element of a game, the covering and uncovering of the eye icon, are all considered to distinguish over the prior art and to be novel, inventive aspects of the present application. Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE PREFERRED EMBODIMENT

Figure 1:
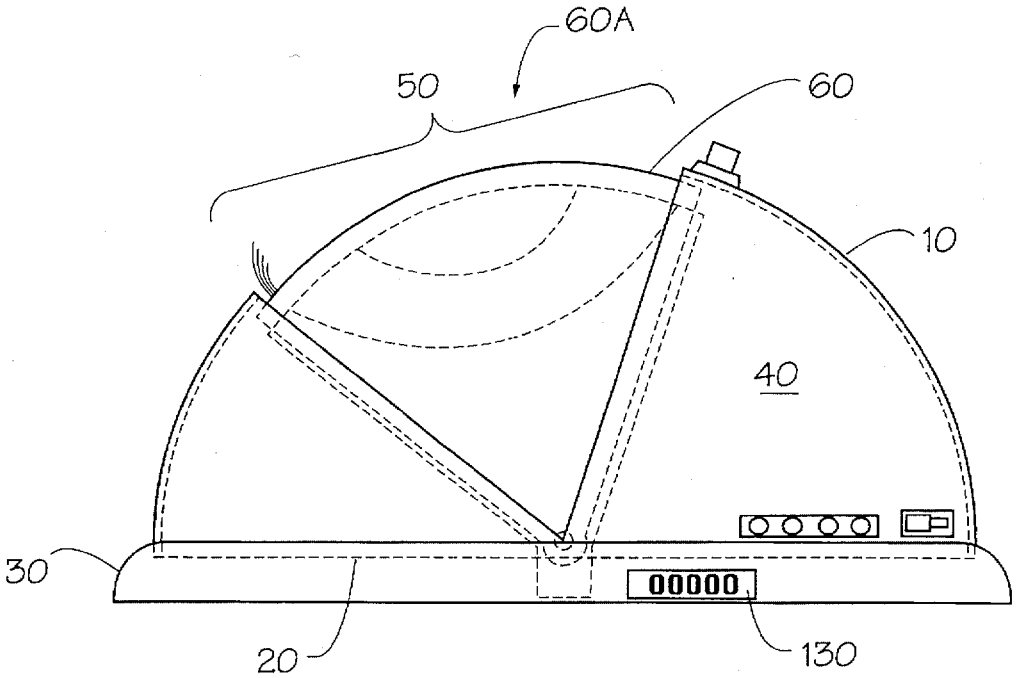
FIG. 1 is a side elevational view of the preferred embodiment of the present invention showing a shutter of the invention in a closed position.
Figure 2:
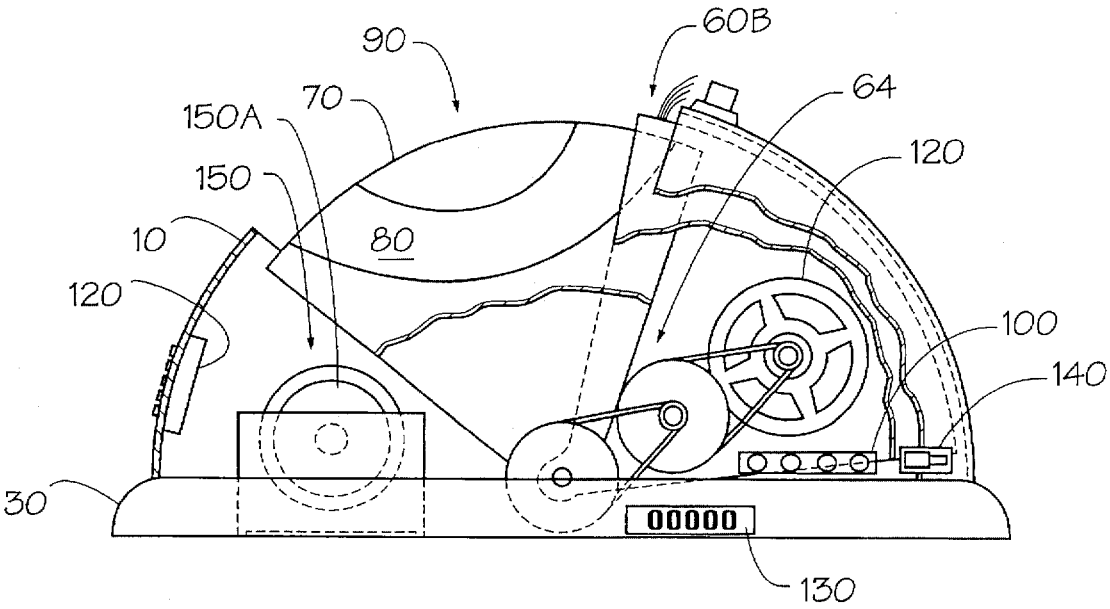
FIG. 2 is a side elevational view thereof showing the shutter of the invention in an open position, and with various portion cut-away to show the interior parts of the invention.

The above described drawing figures illustrate the invention, a game timing device comprising preferably, as shown in FIG. 1, a fixed shell 10 providing a peripheral, downwardly directed edge 20 for mounting the shell 10 on a base 30 and an upwardly directed convex surface 40, the surface having an aperture 50 in it. A shutter 60 is rotationally movable with respect to the shell 10 so that it is positionable in a closed orientation 60A for covering the aperture 50 of the convex surface of the shell, as shown in FIG. 1, and it is further positionable in an open orientation 60B, as shown in FIG. 2, for uncovering the aperture 50.

An insert 70 is fixed within the aperture 50. The insert 70 provides an upwardly directed convex insert surface 80 having a game related image 90 imprinted (or any other means for rendering the image visible) on it, so that with the shutter 60 positioned in the open orientation 60B, the image 90 is visible to players (not shown) seated around the device. With the shutter 60 positioned in the closed orientation 60A, the image 90 is covered so that the players are not able to see it. The base 30 is constructed so that the shell 10, when placed on the base 30, forms an integral unit, the shell 10 and base 30 being joined in a manner allowing the shell 10 to be removed from the base 30 if necessary. The shell 10, insert 70, and base 30 form an enclosure. Positioned within this enclosure is a means for setting 100 of game parameters. Such a setting means is preferably a push button panel or other similar device. The enclosure preferably an electronic numerical processor 110 capable of performing a timing function, and also a motive means 120, such as a small electrical motor interconnected for moving the shutter 60 between the closed 60A and the open 60B positions in response to the timing function of the numerical processor 110.

Preferably, the shell 10, insert 70, shutter 60 and image 90 are jointly formed to resemble an eye, whereupon movement of the shutter 60 is devised to resemble the opening and the closing of an eye lid of the eye. Such a result is useful in establishing desired player responses relative to aspects of the game dealing with elicitation of feelings of knowledge and power.

Enablement in the described apparatus is achieved by including certain electrically actuated elements in the structure of the device, including an audible element 120 such as a buzzer or bell used to signal certain points in time in accordance with game rules, a visual display element 130 such as an LED display panel to show the score of the game or other meaningful information related to game play, a programmable element 140, such as a solid state memory device which might be included with the numerical processor in order to store and later provide certain information related to the game, its score and so on, at least one manual actuation element 140 such as a slide switch for manipulating time duration power status, and so on, and at least one power storage element 150, such as batteries 150A and 150B for providing electrical power to the other elements that require a source of electrical energy. The elements 120–150 are preferably interconnected operatively with other electrical components as necessary to fulfill the operation of the game in accordance with a game operating method and scheme and as anyone skilled in the art would be able to fulfill. Preferably, a time duration in the context of a game format such that a game event is coordinated with the movement of the shutter 60.

Figure 3:
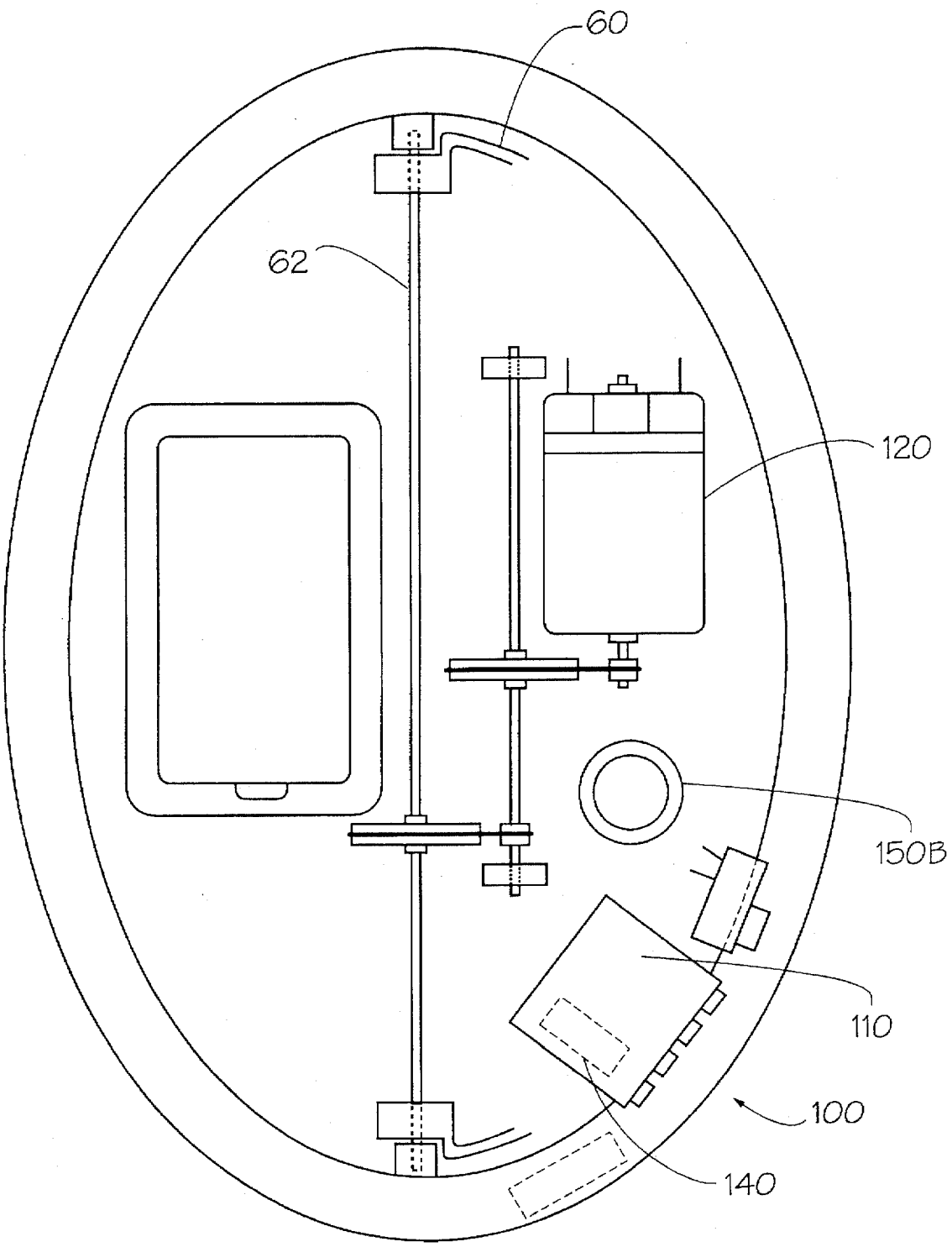
FIG. 3 is a plan view of the invention with a cover shell and the shutter shown removed so as to further define the internal parts and their interrelationships.

The shutter 60 is preferably fixedly mounted to an axle 62 which is driven through a mechanical rotational speed reduction mechanism 64 shown in FIGS. 2 and 3 as a series of pulleys. Other means for moving the shutter 60 would be known by those of skill in the art.

The preferred method of a game played in conjunction with the above described timer device, includes the steps of:

a) providing the game timing device in the form of an eye with a movable eye lid;

b) providing a timer means operable for moving the eye lid in accordance with a predetermined programmable time duration;

c) establishing a game related activity such as answering a question;

d) enabling the start of the time duration at the start of the game related activity;

e) moving the eye lid in accordance with a time-out of the time duration to indicate that the time duration is completed, thereby signaling the end of the related activity.

In the preferred version of the game, the shutter is in the open position with the eye visible when a question of the game is being timed. The player must answer the question before the shutter closes. The shutter speed may be slow or fast determining the final time available to the player to answer the question as the shutter closes. When the shutter is fully closed the audible element may be programmed to sound-off signaling that time is "up." The time duration of step (b) may be predetermined, in an academic version of such a game, or it may be randomly determined by a random number generator in the numerical processor, in a more chance oriented version of the game.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A game timer device comprising:

an enclosure providing a movable portion for covering and uncovering a game related image, the image resembling an eye, and whereupon movement of the movable portion is formed to resemble the opening and the closing of an eye lid of the eye;

a motive means for moving the movable portion in accordance with a timing device;

a means for controlling the timing device for setting a time duration or for selecting a random time mode.

2. A method of a game comprising the steps of:

a) providing a game timer in the form of an eye with movable eye lid;

b) providing a timer means operable for moving the eye lid in accordance with a predetermined time duration;

c) establishing a game related activity;

d) enabling the start of the time duration at the start of the game related activity;

e) moving the eye lid in accordance with a time-out of the time duration to indicate that the time duration is completed signaling the end of the related activity.

3. The method of claim 2 wherein the time duration of step (b) is predetermined.

4. The method of claim 2 wherein the time duration of step (b) is randomly determined.

5. A game timer device comprising:

a shell providing a peripheral, downwardly directed edge for mounting the shell on a base and an upwardly directed surface, the surface providing an aperture therein;

a shutter movable with respect to the shell and positionable in a closed orientation for covering the aperture of the surface of the shell, and further positionable in an open orientation for uncovering the aperture;

an insert fixed within the aperture, the insert providing an upwardly directed insert surface having a game related image thereon, so that with the shutter positioned in the open orientation, the image is visible to players seated around the device, and with the shutter positioned in the closed orientation the image is covered;

the shell, insert, and base forming an enclosure;

and positioned within the enclosure, a means for setting game parameters including a time duration;

a timing device, and a motive means for moving the shutter between the open and the closed positions in response to the timing device and the time duration.

6. The device of claim 5 wherein the shell, insert, shutter and image are formed to resemble an eye, and whereupon movement of the shutter is formed to resemble the opening and the closing of an eye lid of the eye.

7. The game of claim 5 further comprising electrically actuated elements including an audible element, a visual display element, a programming element, at least one manual actuation element, and a power storage element, the elements interconnected operatively for setting the time duration in the context of a game format such that a game event is coordinated with the movement of the shutter.

* * * * *